US005985500A

United States Patent [19]

Fuller et al.

[11] Patent Number: 5,985,500

[45] Date of Patent: Nov. 16, 1999

[54] PHOTORECEPTOR HAVING A FLUOROELASTOMER BLOCKING LAYER

[75] Inventors: Timothy J. Fuller, Pittsford; Markus R. Silvestri; Damodar M. Pai, both of Fairport; John F. Yanus, Webster; Huoy-Jen Yuh, Pittsford; John S. Chambers, Rochester; Ihor W. Tarnawskyj, Webster; Kock-Yee Law, Penfield, all of N.Y.

[73] Assignee: Xerox Corporation, Stamford, Conn.

[21] Appl. No.: 09/133,223

[22] Filed: Aug. 13, 1998

[51] Int. Cl.[6] ..... G03G 5/047; G03G 5/14

[52] U.S. Cl. ..... 430/59.4; 430/64; 430/65

[58] Field of Search ..... 430/58, 59, 60, 430/64, 65, 57, 59.4

[56] References Cited

U.S. PATENT DOCUMENTS

| | | | |
|---|---|---|---|
| 4,377,629 | 3/1983 | Tarumi et al. | 430/64 |
| 4,780,385 | 10/1988 | Wieloch et al. | 430/58 |
| 5,266,431 | 11/1993 | Mammino et al. | 430/96 |
| 5,338,587 | 8/1994 | Mammino et al. | 428/35.7 |
| 5,643,703 | 7/1997 | Daimon et al. | 430/78 |
| 5,654,118 | 8/1997 | Yuh et al. | 430/58 |

FOREIGN PATENT DOCUMENTS

| | | |
|---|---|---|
| 63-125946 | 5/1988 | Japan . |

OTHER PUBLICATIONS

Patent & Trademark Office English–Language Translation of Japanese Patent 63–125946 (Pub May, 1988).

*Primary Examiner*—Janis L. Dote
*Attorney, Agent, or Firm*—Zosan S. Soong

[57] ABSTRACT

A photoreceptor composed of: (a) a substrate; (b) a blocking layer including a fluoroelastomer; (c) a charge generating layer including a binder material and a phthalocyanine; and (d) a charge transport layer.

10 Claims, No Drawings

PHOTORECEPTOR HAVING A FLUOROELASTOMER BLOCKING LAYER

FIELD OF THE INVENTION

This invention relates to a photoreceptor useful in eletrostatographic printing machines.

BACKGROUND OF THE INVENTION

One configuration of a conventional layered organic photoreceptor includes in the following order: a substrate, a blocking layer, an optional adhesive layer, a charge generating layer, and a charge transport layer. Of all the layers in a typical photoreceptor, the most poorly understood may be the blocking layer (also referred to in some situations as an undercoat layer). The blocking layer must effectively block hole injection or else poor charge acceptance and high dark decay will result However, the blocking layer must allow the passage of electrons or else high charge buildup at the blocking layer will occur after light discharge. High charge/electric field buildup results in printout defect (dark spots) in the background areas under Discharge Area Development (DAD) scheme. Conventional materials for the blocking layer include gamma-aminopropyltriethoxysilane, phenolic binder-titanium dioxide, polyvinylchloride-polyacrylonitrile emulsion, zirconium/siliane/partly hydrolyzed polyvinyl butyral, and nylon-terpolymer.

A gamma-aminopropyltriethoxysilane blocking layer has certain disadvantages: a thin layer may be difficult to coat uniformly which can cause print defects in areas unwetted by the barrier film, a thin layer also is susceptible to dielectric breakdown in bias charging roll development systems; uncured gamma-aminopropyltriethoxysilane can interact with the charge generating layer which could reduce photoreceptor sensitivity; low viscosity gamma-aminopropyltriethoxysilane solutions generally cannot be used to make thick coatings, but higher solids coating solutions suffer from shelf life stability issues; and because of its high crosslink density, a gamma-aminopropyltriethoxysilane blocking layer is susceptible to cracking. Thus, there is a need, which the present invention addresses, for new blocking layers that minimize or avoid the problems described above for a gamma-aminopropyltriethoxysilane blocking layer.

Conventional imaging members are disclosed in U.S. Pat. Nos. 5,266,431; 5,338,587; and 5,654,118.

SUMMARY OF THE INVENTION

The present invention is accomplished in embodiments by providing a photoreceptor comprising:

(a) a substrate;

(b) a blocking layer including a fluoroelastomer;

(c) a charge generating layer including a binder material and a phthalocyanine; and (d) a charge transport layer.

DETAILED DESCRIPTION

The present invention is a layered organic photoreceptor which includes in the following order: a substrate, a blocking layer, an optional adhesive layer, a charge generating layer, and a charge transport layer.

The substrate can be formulated entirely of an electrically conductive metal material, or it can be an insulating material having a coating thereon of an electrically conductive metal. Any suitable electrically conductive metal material can be employed such as copper, brass, nickel, magnesium, zinc, chromium, stainless steel, aluminum, steel titanium, zirconium, silver, gold, and alloys of these metals. In embodiments, the substrate is an insulating material having a coating thereon of a metal. Examples of insulating non-conducting materials include polycarbonates, polyamides, polyurethanes, paper, glass, plastic, polyesters such as MYLAR® (available from DuPont) or MELINEX 447® (available from ICI Americas, Inc.), and the like. The substrate can have any number of configurations such as a solid rod, a hollow cylinder having open ends, an endless flexible belt, and the like. In preferred embodiments, the substrate is composed of a polymeric layer having a thickness ranging from about 1 mm to about 10 mm and a metal layer having a thickness ranging from about 0.01 micrometer to about 50 micrometers (in terms of orientation, the metal layer is between the polymeric layer and the blocking layer).

Fluoroelastomer examples include those described in detail in Lentz, U.S. Pat. No. 4,257,699, as well as those described in Eddy et al., U.S. Pat. No. 5,017,432 and Ferguson et al., U.S. Pat. No. 5,061,965, the disclosures of which are totally incorporated by reference. As described therein these fluoroelastomers, particularly from the class of copolymers and terpolymers of vinylidenefluoride, hexafluoropropylene, and tetrafluoroethylene, are known commercially under various designations as VITON A™, VITON E™, VITON E45™, VITON E60C™, VITON E430™, VITON 910™, VITON GH™ and VITON GF™. The VITON™ designation is a Trademark of E. I. Dupont deNemours, Inc. Other commercially available materials include FLUOREL 2170™, FLUOREL 2174™, FLUOREL 2176™, FLUOREL 2177™ and FLUOREL LVS 76™, FLUOREL™ being a Trademark of 3M Company. Additional commercially available materials include AFLAS™ a poly(propylene-tetrafluoroethylene), FLUOREL II™ (LII900) a poly(propylene-tetrafluoroethylene-vinylidenefluoride) both also available from 3M Company as well as the TECNOFLON™ compositions identified as FOR-60KIR, FOR-LHF, NM, FOR-THF, FOR-TFS, TH, TN505 available from Montedison Specialty Chemical Co. Typically, these fluoroelastomers are cured with a nucleophilic addition curing system, such as a bisphenol crosslinking agent with an organophosphonium salt accelerator as described in further detail in the above referenced Lentz Patent and in U.S. Pat. No. 5,017,432. In a particularly preferred embodiment, the fluoroelastomer is one having a relatively low quantity of vinylidenefluoride, such as in VITON GF™, available from E. I. Dupont deNemours, Inc. The VITON GF™ has 35 weight percent vinylidenefluoride, 34 weight percent hexafluoropropylene and 29 weight percent tetrafluoroethylene with 2 weight percent cure site monomer. It is generally cured with bisphenol phosphonium salt, or a conventional aliphatic peroxide curing agent. VITON E45™ is a fluoroelastomer of vinylidenefluoride, hexafluoropropylene, and hexafluoropropylene that has excellent film forming characteristics when solution coated.

In embodiments, the fluoroelastomer does not need to be cured to function as an effective blocking layer. The fluoroelastomer blocking layer can be heated for as little as about 5 minutes at 135 degrees C. to drive off the solvent (e.g., methyl isobutyl ketone). However, the fluoroelastomer can be cured with a crosslinking agent if desired in an amount ranging from about 1% to about 3% by weight of the fluoroelastomer. DIAK III™ having the structure below is a satisfactory curative for the fluoroelastomer such as VITON E45™ if curing temperatures above 170 degrees C. can be used.

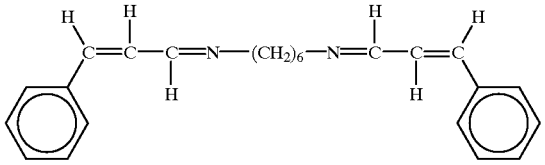

The blocking layer has a thickness ranging for example from about 0.05 to about 5 micrometers, preferably from about 0.1 to about 1 micrometer.

In embodiments, the blocking layer is composed entirely of the fluoroelastomer (if the optional curing agent is used, residual amounts may be present) with no filler material. In other embodiments, the blocking layer includes the fluoroelastomer in an amount from about 50% to about 95% by weight of the blocking layer and at least one filler material in an amount from about 5% to about 50% by weight of the blocking layer.

One or more of the following fillers may be employed in the blocking layer: titanium dioxide, tin oxide that has been surface treated with gamma-aminopropyltriethoxy- or trimethoxy-silane, silicas, boron oxides, and the like.

An adhesive layer may be optionally present between the blocking layer and the charge generating layer. The adhesive layer preferably has a dry thickness between about 0.001 micrometer to about 0.2 micrometer. Typical adhesive layers include film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. Preferably, the adhesive layer is not necessary between the fluoroelastomer layer and the charge generating layer.

In certain embodiments, it may be desirable to include a gamma-aminopropyltriethoxysilane layer (which also functions as a blocking layer) between the substrate and the blocking layer composed of the fluoroelastomer. The gamma-aminopropyltriethoxysilane layer may have a thickness ranging from about 100 to about 500 angstroms, preferably about 250 angstroms. Preferably, however, the blocking layer containing the fluoroelastomer is contiguous to the substrate where there is absent another blocking layer such as the gamma-aminopropyltriethoxysilane layer.

The charge generating layer is composed of a binder material and a phthalocyanine. The phthalocyanine can be metal free phthalocyanine, vanadyl phthalocyanine, copper phthalocyanine, aminochlorophthalocyanine, hydroxygallium phthalocyanine, chlorogallium phthalocyanine, and mixtures therof. The phthalocyanine preferably is type V hydroxygallium phthalocyanine. Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, poly(styrene-block-vinylpyridine), and the like. The generator material (phthalocyanine) is typically present in an amount of about 40 weight percent with the binder polymer being present in an amount of about 60 weight percent, and the coating solution is typically between about 6 and about 18 weight percent solids.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as N,N'-diphenyl-N,N'-bis(3-methylphenyl)-(1,1'-biphenyl)-4,4'-diamine (reference U.S. Pat. No. 4,265,990), carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(-vinyltetraphene); poly(vinyltetracene), poly(vinylperylene), and polycarbonates based on the condensation of N,N'-diphenyl-N,N'-bis(3-hydroxyphenyl)-(1,1'-biphenyl)-4,4'-diamine with phosgene or triphosgene (reference U.S. Pat. No. 4,935,487). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, polyaryleneetherketones, and the like. Molecular weights can vary from about 20,000 to about 1,500,000. Typically, charge transport molecules are present in an amount between about 30 and 50 weight percent, preferably between about 40 and 50 weight percent, with the binder polymer being present in an amount from about 50 to about 70 weight percent. The coating solution is typically about 15 weight percent solids in methylene chloride.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

Other layers which are typically found in photoreceptors can be present such as an overcoating layer contiguous with the charge transport layer.

The present invention using a fluoroelastomer blocking layer offers the following advantages compared with the use of a gamma-aminopropyltriethoxysilane blocking layer: resistance to dielectric breakdown and to the various photoreceptor coating fluids and solvents used during fabrication of the photoreceptor; more uniform and thicker coating of the fluoroelastomer blocking layer; and renders optional the use of an adhesive layer between the blocking layer and the charge generating layer which reduces the number of coatings needed to fabricate the photoreceptor.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated. In addition, unless otherwise indicated, the thickness of the various layers including the blocking layer was determined using SIMS (surface ionization mass spectroscopy). In this case, an oxygen plasma ($O^+$) was used to burn the undercoat layer until the substrate was detected, and the depth of the coating was then measured using profilometry.

EXAMPLE 1

A photoreceptor was prepared by forming coatings using conventional techniques on a substrate comprising a vacuum deposited titanium/zirconium layer on a polyethylene terephthalate film. The first barrier coating is a coating of this invention and was formed by dissolving 0.1 g of VITON E45™ resin and 0 g of DIAK III™ in 9 g of methyl isobutyl ketone followed by coating with a 0.25 mil Bird Bar applicator. The film was dried at 150° C. for 5 minutes resulting in a dried thickness of 0.15 micrometers. The second optional coating was an adhesive layer of polyester resin (49,000 adhesive, available from E. I. duPont de Nemours & Co.) having a thickness of 0.005 micron (50 Angstroms). The second optional coating composition was applied using a 0.5 mil bar and the resulting coating was cured in a forced air oven for 10 minutes. This adhesive interface layer was thereafter coated with a photogenerating layer containing 40 percent by volume hydroxygallium phthalocyanine and 60 percent by volume of a block copolymer of styrene (82 percent)/4-vinyl pyridine (18 percent) having a molecular weight of 11,000. This photogenerator coating composition was prepared by dissolving 1.5 g of the block copolymer of styrene/4-vinyl pyridine in 42 ml of toluene. To this solution was added 1.33 g of hydroxygallium phthalocyanine and 300 g of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. This layer was dried at 135° C. for 5 minutes in a forced air oven to form a photogenerating layer having a dry thickness of 0.4 micrometer. The next applied layer was a transport layer which was formed by using a Bird coating applicator to apply a solution containing one gram of N,N'-diphenyl-N,N'-bis(3-methylphenyl)-(1,1'-biphenyl)-4,4'-diamine and one gram of polycarbonate resin poly(4,4'-isopropylidene-diphenylene carbonate (available as MAKROLON-™ from Farbenfabricken Bayer A.G.) dissolved in 11.5 g of methylene chloride solvent. The N,N'-diphenyl-N,N'-bis(3-methylphenyl)-(1,1'-biphenyl)-4,4'-diamine is an electrically active aromatic diamine charge transport small molecule whereas the polycarbonate resin is an electrically inactive film forming binder. The coated device was dried at 80° C. for half an hour in a forced air oven to form a dry 25 micrometer thick charge transport layer The device of Example 1 was tested for xerographic sensitivity and cyclic stability. The photoreceptor device was mounted on a cylindrical aluminum drum substrate which was rotated on a shaft of a scanner. The photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptor on the drum was exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of known intensity. The photoreceptor was erased by a light source located at a position upstream of charging. The measurements made included charging of the photoreceptor in a constant current and voltage mode. The photoreceptor was charged to a negative polarity corona. As the drum was rotated, the initial charging potential was measured by voltage probe 1. Further rotation leads to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The background voltage at about 6 ergs/cm$^2$, the residual voltage after about 4,000 cycles, and the residual voltage after about 10,000 cycles were also measured. The test results are shown in Table 1.

EXAMPLE 2

A second inventive photoreceptor was fabricated and tested using the same procedures described in Example 1 except that the hole blocking barrier layer composition was different. It was formed by dissolving 0.1 g of VITON E45™ resin and 0.001 g of DIAK III™ in 9 g of methyl isobutyl ketone followed by coating with a 0.25 mil Bird Bar applicator. The film was dried at 150° C. for 5 minutes resulting in a dried thickness of 0.15 micrometer. The test results are shown in Table 1.

EXAMPLE 3

A third inventive photoreceptor was fabricated and tested using the same procedures described in Example 2 except that the amount of the DIAK III™ is about twice the value. The resulting dried blocking layer had a thickness of about 0.15 micrometer. The test results are shown in Table 1.

EXAMPLE 4

A fourth inventive photoreceptor was fabricated and tested using the same procedures described in Example 2 except that the amount of the DIAK III™ is about three times the value. The resulting dried blocking layer had a thickness of about 0.15 micrometer. The test results are shown in Table 1.

EXAMPLE 5

A fifth inventive photoreceptor was fabricated and tested using the same procedures described in Example 1 except that the amount of the VITON E45™ was increased. A solution was formed by dissolving 0.25 g of VITON E45™ resin and 0 g of DIAK III™ in 9 g of methyl isobutyl ketone followed by coating with a 0.25 mil Bird Bar applicator. The film was dried at 150° C. for 5 minutes resulting in a dried thickness of 0.15 micrometer. The test results are shown in Table 1.

EXAMPLE 6

A sixth inventive photoreceptor was fabricated and tested using the same procedures described in Example 5 except that the amount of the DIAK III™ was increased. A solution was formed by dissolving 0.25 g of VITON E45™ resin and 0.0025 g of DIAK III™ in 9 g of methyl isobutyl ketone followed by coating with a 0.25 mil Bird Bar applicator. The film was dried at 150° C. for 5 minutes resulting in a dried thickness of 0.15 micrometer. The test results are shown in Table 1.

EXAMPLE 7

A seventh inventive photoreceptor was fabricated and tested using the same procedures described in Example 1 except that the amount of the VITON E45™ was increased. A solution was formed by dissolving 0.5 g of VITON E45™ resin and 0 g of DIAK III™ in 9 g of methyl isobutyl ketone followed by coating with a 0.25 mil Bird Bar applicator. The film was dried at 150° C. for 5 minutes resulting in a dried thickness of 0.26 micrometer. The test results are shown in Table 1.

EXAMPLE 8

An eighth inventive photoreceptor was fabricated and tested using the same procedures described in Example 7 except that the amount of the DIAK III™ was increased. A solution was formed by dissolving 0.5 g of VITON E45™ resin and 0.005 g of DIAK III™ in 9 g of methyl isobutyl ketone followed by coating with a 0.25 mil Bird Bar applicator. The film was dried at 150° C. for 5 minutes resulting in a dried thickness of 0.26 micrometer. The test results are shown in Table 1.

EXAMPLE 9

A ninth inventive photoreceptor was fabricated and tested using the same procedures described in Example 1 except that the amount of the VITON E45™ was increased. A solution was formed by dissolving 0.8 g of VITON E45™ resin and 0 g of DIAK III™ in 9 g of methyl isobutyl ketone followed by coating with a 0.25 mil Bird Bar applicator. The film was dried at 150° C. for 5 minutes resulting in a dried thickness of 0.15 micrometer. The test results are shown in Table 1.

EXAMPLE 10

A tenth inventive photoreceptor was fabricated and tested using the same procedures described in Example 9 except that the amount of the DIAK III™ was increased. A solution was formed by dissolving 0.8 g of VITON E45™ resin and 0.008 g of DIAK III™ in 9 g of methyl isobutyl ketone was formed coating with a 0.25 mil Bird Bar applicator. The film was dried at 150° C. for 5 minutes resulting in a dried thickness of 0.15 micrometer. The test results are shown in Table 1.

EXAMPLE 11

An eleventh inventive photoreceptor was fabricated and tested using the same procedures described in Example 1 except that except that the amounts of the VITON E45™ and DIAK III™ were increased. A solution was formed by dissolving 1 g of Viton E45 resin and 0.01 g of DIAK III™ in 9 g of methyl isobutyl ketone followed by coating with a 0.25 mil Bird Bar applicator. The film was dried at 150° C. for 5 minutes resulting in a dried thickness of 0.15 micrometer. The test results are shown in Table 1.

TABLE 1

| Viton | Diak III | | | |
|---|---|---|---|---|
| E45 | 0% | 1% | 2% | 3% |
| 1% | 7*, 3**, 3*** (Example 1) | 8*, 4**, 8*** (Example 2) | 13*, 6**, 11*** (Example 3) | 17*, 7**, 5*** (Example 4) |
| 2.7% | 17*, 8**, 9*** (Example 5) | 16*, 10**, 11*** (Example 6) | — | — |
| 5.26% | 29*, 15**, 25*** (Example 7) | 20*, 13**, 25*** (Example 8) | — | — |
| 8.16% | 31*, 16**, 31*** (Example 9) | 30*, 15**, 39*** (Example 10) | — | — |
| 10% | — | 27*, 16**, 37*** (Example 11) | — | — |

In Table 1, the DIAK III ™ amounts are in weight percent based on the weight of the VITON E45 ™ and the DIAK III ™.
In Table 1, the VITON E45 ™ amounts are in weight percent based on the weight of the VITON E45 ™ , DIAK III ™, and methyl isobutyl ketone.
*background voltage (unit is volts) at about 6 ergs/cm$^2$;
**residual voltage (unit is volts) after about 4,000 cycles; and
***residual voltage (unit is volts) after about 10,000 cycles.

The eleven inventive photoreceptors all exhibited satisfactory background and residual voltages with optimal fluoroelastomer and curative concentrations suggested by the data in Table 1. Thus, no adverse effects or poisoning of the charge generating layer by the VITON E45™ or the DIAK III™ was observed in any of the inventive examples. In addition, the adhesion of the fluoroelastomer blocking layer to the substrate was very good because it was determined that the photoreceptors would break in peel tests before delamination would occur. Additional devices corresponding to VITON E45™ at 2.7% and the DIAK III™ at 2% and 3%; VITON E45™ at 5.26% and the DIAK III™ at 2% and 3%; VITON E45™ at 8.16% and the DIAK III™ at 2% and 3%; VITON E45™ at 10% and the DIAK III™ at 0%, 2% and 3%, were also fabricated except the electrical properties were outside the range of performance that can be tolerated.

COMPARATIVE EXAMPLE 1

A first comparative photoreceptor was fabricated and tested using the same procedures described in Example 1 except that the blocking layer was composed entirely of gamma-aminopropyltriethoxysilane having a thickness of 0.005 micrometer (50 Angstroms). The barrier layer coating composition was prepared by mixing 3-aminopropyltriethoxysilane (available from PCR Research Center Chemicals of Florida) with ethanol in a 1:50 volume ratio. The coating composition was applied by a multiple clearance film applicator to form a coating having a wet thickness of 0.5 mil. The coating was then allowed to dry for 5 minutes at room temperature, followed by curing for 10 minutes at 110 degree centigrade in a forced air oven. The first comparative photoreceptor exhibited the following: background voltage of 15 volts at about 6 ergs/cm$^2$, a residual voltage of 3 volts after about 4,000 cycles, and a residual voltage of 1 volt after about 10,000 cycles.

The first comparative photoreceptor is a control sample which is known to perform satisfactorily with respect to background and residual voltage values. As seen in Table 1, the eleven inventive photoreceptors performed in a manner equivalent to that of the first comparative photoreceptor.

COMPARATIVE EXAMPLE 2

A second comparative photoreceptor was fabricated and tested using the same procedures described in Example 1 except that the charge generating layer contained benzimidazole perylene ("BZP"). The generator layer contained 40 percent by volume benzimidazole perylene and 60 percent by volume poly(4,4'-diphenyl-1,1'-cyclohexane carbonate). This photogenerating layer was prepared by introducing 0.3 g of poly(4,4'-diphenyl-1,1'-cyclohexane carbonate), PCZ-200 available from Mitsubishi Gas Chem. and 48 ml of tetrahydrofuran into a 4 oz amber bottle. To this solution was added 1.6 g of benzimidazole Perylene (BZP) and 300 g of ⅛ inch diameter steel shots. This mixture was then placed on a ball mill for 96 hours. About 10 g of the resulting dispersion was added to a solution containing 0.547 g of poly(4,4'-diphenyl-1,1'-cyclohexane carbonate), PCZ-200 and 6–14 g of tetrahydrofuran. The resulting slurry was thereafter applied to the adhesive interface with a ½ mil gap Bird applicator to form a layer having a wet thickness of 0.5 mil. The layer was dried at 135° C. for 5 minutes in a forced air oven to form a dry photogenerating layer having a thickness of about 1.2 micrometers. The test results are shown in Table 2.

COMPARATIVE EXAMPLE 3

A third comparative photoreceptor was fabricated and tested using the same procedures described in Example 2 except that the charge generating layer contained benzimidazole perylene ("BZP") which was prepared as described in Comparative Example 2. The test results are shown in Table 2.

COMPARATIVE EXAMPLE 4

A fourth comparative photoreceptor was fabricated and tested using the same procedures described in Example 1 except that the charge generating layer ("CGL") contained trigonal selenium ("t-Se"). The generator layer coating was applied with a 0.005 inch Bird applicator and the layer was dried at about 135° C. in a forced air oven to form a layer having a 1.6 micrometer thickness. The test results are shown in Table 2.

COMPARATIVE EXAMPLE 5

A fifth comparative photoreceptor was fabricated and tested using the same procedures described in Example 2 except that the charge generating layer ("CGL") contained trigonal selenium ("t-Se") which was prepared as described in Comparative Example 4. The test results are shown in Table 2.

TABLE 2

| | Diak | |
|---|---|---|
| CGL | 0% | 1% |
| BZP | No charge acceptance (Comp. Ex. 2) | No charge acceptance (Comp. Ex. 3) |
| t-Se | 102*, 55**, 62*** (Comp. Ex. 4) | 70*, 27**, 30*** (Comp. Ex. 5) |

In Table 2, the Diak III ™ amounts are in weight percent based on the weight of the VITON E45 ™ and the DIAK III ™.
*background voltage (unit is volts) at about 6 ergs/cm$^2$;
**residual voltage (unit is volts) after about 4,000 cycles; and
***residual voltage (unit is volts) after about 10,000 cycles.

Under the specific conditions described in the comparative examples, it appeared that photoreceptors containing a fluoroelastomer blocking layer were unsatisfactory when the charge generating layer contained either BZP (no charge acceptance) or t-Se (unacceptably high background and residual voltages, i.e., loss of sensitivity).

Other modifications of the present invention may occur to those skilled in the art based upon a reading of the present disclosure and these modifications are intended to be included within the scope of the present invention

We claim:

1. A photoreceptor comprising:

(a) a substrate having an electrically conductive surface;

(b) a blocking layer including a fluoroelastomer wherein the fluoroelastomer is cured with a crosslinking agent;

(c) a charge generating layer including a binder material and a phthalocyanine; and (c) a charge transport layer.

2. The photoreceptor of claim 1, further comprising a gamma-aminopropyltriethoxysilane layer between the blocking layer and the substrate.

3. The photoreceptor of claim 1, wherein there is absent another blocking layer between the blocking layer including the fluoroelastomer and the substrate.

4. The photoreceptor of claim 1, wherein the fluoroelastomer is a copolymer or terpolymer having monomers selected from the group consisting of: vinylidenefluoride, hexafluoropropylene, and tetrafluoroethylene.

5. The photoreceptor of claim 1, wherein the fluoroelastomer is a terpolymer including monomers of vinylidenefluoride, tetrafluoroethylene, and hexafluoropropylene.

6. The photoreceptor of claim 1, wherein the blocking layer has a thickness ranging from about 0.1 to about 1 micrometer.

7. The photoreceptor of claim 1, wherein the blocking layer includes the fluoroelastomer in an amount from about 50% to about 95% by weight of the blocking layer and at least one filler material in an amount from about 5% to about 50% by weight of the blocking layer.

8. The photoreceptor of claim 1, wherein the phthalocyanine is hydroxygallium phthalocyanine.

9. The photoreceptor of claim 1, wherein the substrate comprises a polymeric layer and a metal layer.

10. The photoreceptor of claim 1, wherein the photoreceptor has the shape of an endless belt.

* * * * *